US005133165A

United States Patent [19]

Wimberly

[11] Patent Number: 5,133,165

[45] Date of Patent: Jul. 28, 1992

[54] OUTLET COVER U-TRIM

[75] Inventor: Joseph W. Wimberly, Villa Park, Ill.

[73] Assignee: Taurus Safety Products, Inc., Lombard, Ill.

[21] Appl. No.: 673,473

[22] Filed: Mar. 22, 1991

[51] Int. Cl.[5] ..... E04F 19/02

[52] U.S. Cl. ..... 52/221; 52/287; 52/716

[58] Field of Search ..... 52/287, 221, 514, 716; 174/48, 49, 66, 101; 220/3.3, 3.5, 3.6

[56] References Cited

U.S. PATENT DOCUMENTS

| | | | |
|---|---|---|---|
| 1,044,533 | 11/1912 | Johnstn | 52/211 |
| 3,236,545 | 2/1966 | Parkes et al. | 174/48 |
| 3,707,165 | 12/1972 | Stahl | 174/48 |
| 3,909,912 | 10/1975 | Kiesling | 52/211 |
| 4,296,870 | 10/1981 | Balkwill et al. | 220/3.3 |
| 4,327,841 | 5/1982 | Wimberly | 174/66 |
| 4,608,800 | 9/1986 | Fredette | 52/211 |
| 4,726,152 | 2/1988 | Vagedes et al. | 52/211 |
| 4,854,093 | 8/1989 | Kellom | 52/211 |
| 4,920,708 | 5/1990 | Macleod et al. | 52/60 |

FOREIGN PATENT DOCUMENTS

| | | | |
|---|---|---|---|
| 2153889 | 8/1985 | United Kingdom | 52/211 |

*Primary Examiner*—Michael Safavi

*Attorney, Agent, or Firm*—Hill, Van Santen, Steadman & Simpson

[57] ABSTRACT

A trim ring for ornamentally embracing in complementary relation an outlet box cover attached to a sliding covered external building wall, and comprising a one-piece member having an outlet box cover-encircling and embracing wall, and spaced opposed flanges integral with the member wall defining a channel about the member wall for receiving and concealing siding edges located adjacent to the outlet box cover.

18 Claims, 1 Drawing Sheet

OUTLET COVER U-TRIM

BACKGROUND OF THE INVENTION

The present invention relates to improvements in insulated outlet cover structures such as disclosed in U.S. Pat. No. 4,327,841. In that patent, there is provided a novel cover for covering an outlet box mounted on an exterior building wall. Such cover is formed of a single piece of plastic and provided with an outer wall having an opening to provide access to an outlet box. A surrounding wall is integrally joined to the periphery of the outer wall and extends substantially normal thereto and is provided at its inner end with an integrally joined attaching flange for being placed against a building wall and fastened in place.

Attention is also directed to U.S. Pat. No. 4,726,152 which discloses a similar structure having an integral flange extending from the outer wall and cooperating with an attached L-shaped attachment flange for providing a siding edge receiving channel.

SUMMARY OF THE PRESENT INVENTION

An important object of the present invention is to provide a new and improved simplified conveniently applicable trim means for embracing in complementary relation an outlet box cover such as that disclosed in U.S. Pat. No. 4,327,841, and providing a more simple and convenient channel arrangement than in the U.S. Pat. No. 4,726,152, for receiving and concealing siding edges located adjacent to the outlet box cover.

Pursuant to the present invention there is provided trim means for ornamentally embracing in complementary relation an outlet box cover attached to a siding-covered external building wall, and comprising a one-piece generally ring-shaped member having an outlet box-encircling and embracing wall, and spaced opposed flanges integral with the member wall defining a channel about the member wall for receiving and concealing siding edges.

There is also provided by the present invention a method of concealing siding edges located adjacent to an outlet box cover, comprising embracing the cover with an outlet box cover-encircling wall of a one-piece trim member, and in a channel defined by spaced opposed flanges integral with the trim member wall receiving and concealing the siding edges.

BRIEF DESCRIPTION OF THE DRAWINGS

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which.

DETAILED DESCRIPTION

Figure 1:
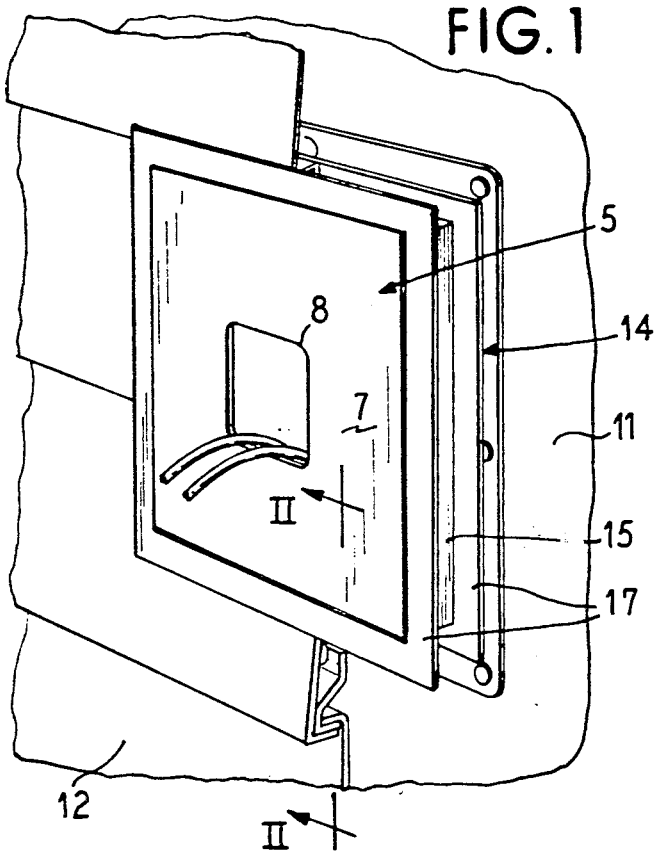
FIG. 1 is a fragmentary perspective view of an outlet box cover with an embracing trim means according to the present invention.

Referring to the drawinqs, an outlet box cover 5 is depicted, essentially similar to that disclosed in U.S. Pat. No. 4,327,841, and to any extent necessary that patent is incorporated herein by reference to avoid need for repetitious description. Suffice it to say that the outlet box cover 5 comprises a unit made from a dielectric material such as a suitable moldable plastic and has an outer wall panel 7 which is adapted to have an opening 8 for access to an outlet box (not shown). A surrounding wall 9 extends axially angularly from the outer wall panel 7 and joins a laterally outwardly extending attaching flange 10 by which the outlet box cover is adapted to be attached as by nailing to an external building wall 11 covered with any preferred style of siding 12 having edges 13 adjacent to the cover wall 9. As shown, the cover 5 is multiangular in plan.

The panel 7 is parallel to the building wall 11, and the cover wall 9 extends axially inwardly from the perimeter of the panel 7 to the attaching flange 10.

Whereas the siding edges 13 may be in as close as practicable contiguity to the cover wall 9, and the joint, as heretofore, caulked, the present invention avoids the need for caulking and provides an ornamental concealment of the edges 13 by the provision of trim means 14.

In a preferred construction, the trim means 14 comprises a one-piece, continuous and joint-free, generally ring-shaped member having an outlet box cover-encircling complementary (quadrangular as shown), and cover wall 9, i.e. closely engaging embracing wall 15. Spaced opposed laterally extending flanges 17 integral with the wall 15 overlie the attaching flange 10 and define a generally U-shaped cross section channel 18 about the wall 15 for receiving and concealing those siding edges 13 which are located adjacent to the outlet box cover wall 9.

Figure 2:
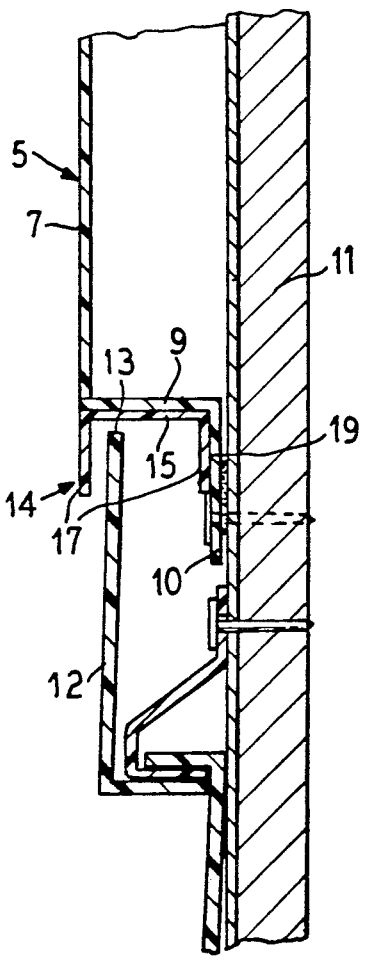
FIG. 2 is an enlarged fragmentary sectional detail view taken substantially along the line II—II in FIG. 1.
Figure 3:
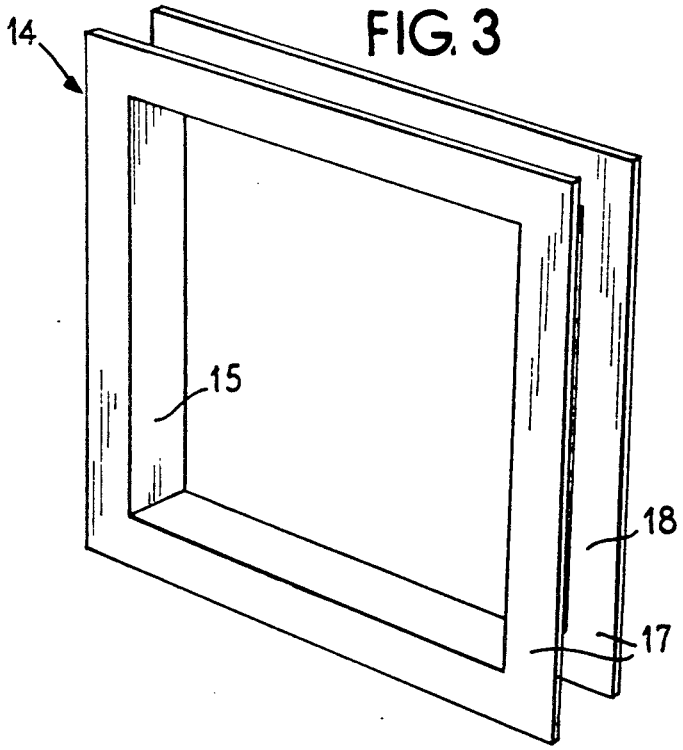
FIG. 3 is a perspective view of a one-piece trim member according to the present invention.

As is clearly evident in FIG. 2, the only way the integrally one-piece molded trim member 14 can be assembled with the cover 5 is by axially slidably assembling the wall 15 onto the cover wall 9. Such slidable assembly is possible because the juncture of the perimeter of the panel 7 with the cover wall 15 is free from any obstruction to the sliding reception of the wall 15 past such juncture and into slidably embracing relation to the wall 9.

When installing the trim member 14 about the cover 5, there may be an interval before the siding 12 is applied, and it may be desirable to provide some retaining means, permanent or temporary, such as adhesive, mastic or cement 19 or other means merans between or in association with the innermost flange 17 and the opposed flange 10.

Although the trim member 14 may be shaped from any suitable material, either metallic or plastic, it is preferably formed from a moldable material so that the generally ring-shaped member 14 may be readily molded according to any preferred molding practice. Excellent results are attained by having the member 14 molded from polypropylene, which is a lightweight, self-sustaining durable plastic.

In a practical form, the member 14 may have the wall 15 and the flanges 17 of about .040 thickness, with the wall 15 of about ¾" straight width which is the same as the width of the cover wall 9, and the flanges 17 about ⅝" width.

It will observed that the trim member 14 not only provides an ornamental concealment for the siding edges, but also provides an attractive addition to the outlet box cover 5. Further, by virtue of its simple assembly addition to the outlet box cover 5, the trim member 14 affords an optional addition to the outlet box cover so that users of the outlet box cover not desiring to have the trim ring addition may do without it, although, as is obvious, the trim ring member 14 does provide a neat, attractive ornamental and useful addition which may be supplied at low cost and will thus be highly desirable for most users.

By well known techniques, of course, the siding 12 may be provided homogeneously in various colors or may be painted with various colors. Similarly, the trim ring member 14 may be provided with various colors to suit preferences.

It will be apparent that various modifications and/or additions may be made in the structure of the invention without departing from the essential features of novelty involved, which are intended to be defined and secured by the appended claims.

I claim:

1. Trim means ornamentally embracing in complementary relation an outlet box cover attached to a siding-covered external building wall, said cover having an outwardly facing wall panel parallel to the building wall and an axially inwardly extending wall projecting from an outer unobstructed perimeter of the panel to a juncture with a laterally extending attachment flange by which the cover is attached to the building wall, and with edges of the siding located adjacent to said cover, and comprising:

a one-piece generally ring-shaped member having an outlet box cover-encircling axially extending wall axially slidably engaging said axially extending wall of said cover; and spaced opposed flanges forming laterally extending flange means integral with said member wall in overlying relation to said attachment flange and defining a channel about said member wall for receiving and concealing said siding edges.

2. Trim means according to claim 1, wherein said member comprises a one-piece plastic molding in which said member wall is of integrally continuous ring shape and said flange means is continuous and uninterrupted about said member wall.

3. Trim means according to claim 1, wherein said member wall and flange means are continuous and joint-free.

4. Trim means according to claim 3, wherein said member comprises a one-piece continuous and uninterrupted ring-shaped plastic molding.

5. Trim means according to claim 1, wherein said member is multiangular in plan to fit in complementary close fitting relation a multiangular outline of said outlet box cover axially extending wall.

6. Trim means according to claim 1, wherein said member is of ring-shape in which said member wall and flange means cooperate in a generally U-shaped cross-section formation and with said member wall and flange means each being straight and flat in cross-section.

7. Trim means according to claim 1, including means for holding said member in place about said cover at least until the siding edges are received in said channel.

8. A method of concealing siding edges located adjacent to an outlet box cover mounted on a building wall and having an outer wall panel parallel to said building wall and an axially inwardly extending wall of predetermined width projecting from an unobstructed outer perimeter of said panel to a juncture with a laterally extending attachment flange by which the cover is attached to said building wall, and comprising:

sliding axially into embracing engagement with the width of said cover wall an outlet box cover-encircling complementary wall of a generally ring-shaped one-piece trim member; and in a channel defined by spaced opposed flanges forming lateral flange means integral with said member wall and overlying said attachment flange, receiving said siding edges.

9. A method according to claim 8, comprising providing said member rectangular in plan to fit a rectangular outline of said outlet box cover.

10. A method according to claim 8, comprising providing said member in U-shaped cross-section.

11. A method according to claim 8, comprising retaining said member in place about said cover until the siding edges have been received in said channel.

12. Trim means ornamentally embracing in complementary slidably assembled relation an outlet box cover adapted to be attached to a siding covered external building wall and with edges of the siding located adjacent to the cover, said cover having an outwardly facing wall panel and said wall panel adapted to be parallel to a building wall on which mounted, an axially inwardly extending wall of predetermined width projecting from an outer unobstructed perimeter of said panel to join with a laterally extending attachment flange by which the cover is adapted to be attached to the building wall, and comprising:

a one-piece member having an outlet box cover-encircling axially extending wall closely axially slidably engaging said axially extending wall of said cover throughout its width; and spaced opposed flanges forming laterally extending flange means integral with said member wall in overlying relation to said attaching flange and defining a channel about said member wall for receiving and concealing said siding edges.

13. Trim means according to claim 12, wherein said member comprises a one-piece plastic molding in which said member wall is of integrally continuous straight flat ring shape and said flange means is continuous and uninterrupted about said member wall.

14. Trim means according to claim 12, wherein said member wall and flange means are continuous and joint-free.

15. Trim means according to claim 14, wherein said member comprises a one-piece continuous and uninterrupted ring-shaped plastic molding.

16. Trim means according to claim 12, wherein said member is rectangular in plan to fit in complementary close fitting relation rectangular outline of the outlet box cover axially extending wall.

17. Trim means according to claim 12, wherein said member is of ring-shape in which said member wall and flange means cooperate in a generally U-shaped cross-section formation and with said member wall and flange means each being straight and flat in cross-section.

18. Trim means according to claim 12, including means for holding said member in place about said cover at least until the siding edges are received in said channel.

* * * * *